US005311269A

United States Patent [19]

Aslam et al.

[11] Patent Number: 5,311,269

[45] Date of Patent: May 10, 1994

[54] TONER IMAGE FINISHING APPARATUS

[75] Inventors: Muhammad Aslam; Thomas J. Farnand, Webster; Thomas W. Mort, Rochester, all of N.Y.

[73] Assignee: Eastman Kodak Company, Rochester, N.Y.

[21] Appl. No.: 42,432

[22] Filed: Apr. 5, 1993

[51] Int. Cl.[5] ..... G03G 15/20

[52] U.S. Cl. ..... 355/285; 219/216; 355/290

[58] Field of Search ..... 355/290, 295, 285, 282, 355/283, 284, 286, 287, 288, 289, 291, 292, 293, 294; 219/216, 469–471; 271/272–274

[56] References Cited

U.S. PATENT DOCUMENTS

| | | | |
|---|---|---|---|
| 2,805,856 | 9/1957 | Stuchbery | 271/272 |
| 3,754,819 | 8/1973 | Braun | 355/295 |
| 4,001,544 | 1/1977 | Heinzer et al. | 219/216 |
| 4,287,409 | 9/1981 | Auchinleck | 271/274 X |
| 4,341,458 | 7/1982 | Glasa et al. | 355/290 |
| 4,958,195 | 9/1990 | Firth et al. | 355/290 |
| 4,972,232 | 11/1990 | Hoover et al. | 355/295 |
| 5,053,829 | 10/1991 | Field et al. | 355/290 |
| 5,111,250 | 5/1992 | Kashiwaagi | 355/285 |
| 5,118,589 | 6/1992 | Aslam et al. | 430/124 |
| 5,148,226 | 9/1992 | Setoriyama et al. | 355/290 |

FOREIGN PATENT DOCUMENTS

| | | | |
|---|---|---|---|
| 55-123834 | 9/1980 | Japan | 271/272 |

OTHER PUBLICATIONS

Machmer, J. A.; "Sheet Feed Control"; Aug. 1973; vol. 16, No. 3, p. 900; IBM Technical Disclosure Bulletin.

Chang, J. P.; "Stress-Alleviating Back-Up Roll"; May, 1982; vol. 24, No. 12, pp. 6354–6355; IBM Techical Disclosure Bulletin.

*Primary Examiner*—A. T. Grimley
*Assistant Examiner*—Shuk Y. Lee
*Attorney, Agent, or Firm*—Leonard W. Treash, Jr.

[57] ABSTRACT

A toner image carried by heat softenable layer on a receiving sheet is either fixed or texturized by a pair of pressure members. The pressure members include a fusing member and a pressure roller. To prevent hot offset of the leading portion of the heat softenable layer, a recess in the pressure roller receives the leading edge of the receiving sheet, thus reducing the pressure in the nip for the leading portion of the receiving sheet.

7 Claims, 7 Drawing Sheets

TONER IMAGE FINISHING APPARATUS

This invention relates to the finishing of toner images carried on a receiving sheet. More specifically, it relates to apparatus for fixing or texturizing a toner image carried on a heat softenable layer on a receiving sheet.

This specification discloses alternative solutions to a problem disclosed in U.S. Pat. No. 5,118,589, granted to Aslam et al Jun. 2, 1992. That patent is incorporated by reference herein.

U.S. Pat. No. 5,118,589 discloses a problem associated with finishing toner images on receiving sheets having a heat softenable thermoplastic layer supporting the toner image. As the receiving sheet enters a nip formed between fusing or texturizing pressure members, the pressure members are often slowed slightly by the leading edge of the sheet. This slowing of the pressure members can cause excessive heating of the thermoplastic adjacent the leading edge which, in turn, can cause hot offset of the thermoplastic onto the pressure member that it touches. The above patent suggests releasing the nip before entry of the sheet and applying the force creating the nip pressure as the leading edge reaches the center of the nip. The preferred embodiment disclosed in that patent shows the use of a pneumatic pressure applying mechanism and a sensor which senses the approach of the receiving sheet to actuate the pressure applying mechanism (through a suitable delay) when the leading edge is in the nip.

U.S. Pat. No. 5,234,782, Aslam et al issued Aug. 10, 1993, suggests solving the same problem by terminating the coating of the thermoplastic layer on the receiving sheet a short distance before the edge so that there is no thermoplastic to offset in response to slowing of the pressure members.

U.S. Pat. No. 4,958,195, granted to Firth et al Sep. 18, 1990, suggests that a problem associated with envelopes can be managed by sensing the trailing edge of a receiving sheet envelope entering a roller fuser and automatically reducing the pressure in the nip a controlled time thereafter corresponding to the entrance of the envelope flap into the nip. Other patents which provide various mechanisms for controlling the pressure in a fusing nip include U.S. Pat. No. 4,341,458, U.S. Pat. No. 4,972,232, U.S. Pat. No. 3,745,819 and U.S. Pat. No. 5,111,250.

SUMMARY OF THE INVENTION

It is an object of the invention to provide apparatus for finishing toner images carried on a heat softenable layer on a receiving sheet that solves the above problem without some of the complexity associated with the prior art.

This and other objects are accomplished by apparatus for finishing such toner images which includes a pair of pressure members which form a pressure nip. The pressure members include a fusing member, for example, a fusing roller or a fusing belt or web, and a pressure roller. The apparatus includes means for heating at least one of the pressure members, means for driving at least one of the pressure members to move the receiving sheet through the pressure nip, and means for feeding the receiving sheet into the nip with the heat softenable layer facing the fusing member. To prevent hot offset of the portion of the heat softenable layer adjacent to the leading edge of the receiving sheet, the pressure roller has a crosstrack recess for receiving the leading edge of the receiving sheet as it is fed into the pressure nip to reduce the pressure on the leading edge of the receiving sheet as compared to the rest of the sheet as the sheet moves through the nip.

According to a preferred embodiment, the recess in the pressure roller can be variously shaped. For example, the roller can be predominantly cylindrical with a flat portion making it D-shaped. Alternatively, the recess can have two sides to it being somewhat V-shaped. The recess can extend across the entire roller or just a portion of the roller equal to the crosstrack dimension of the receiving sheet. The latter construction permits cylindrical ends of the roller to be driven by the fusing member while the recess is in the nip.

It is within the concept of the invention that a mechanically controlled reduction in pressure between the pressure members while the leading edge is in the nip, as disclosed in U.S. Pat. No. 5,118,589 described above, can be used in conjunction with this invention. However, the preferred embodiments provide satisfactory results without such a mechanical pressure reduction device, thereby simplifying the apparatus.

DESCRIPTION OF THE PREFERRED EMBODIMENTS

Figure 1:
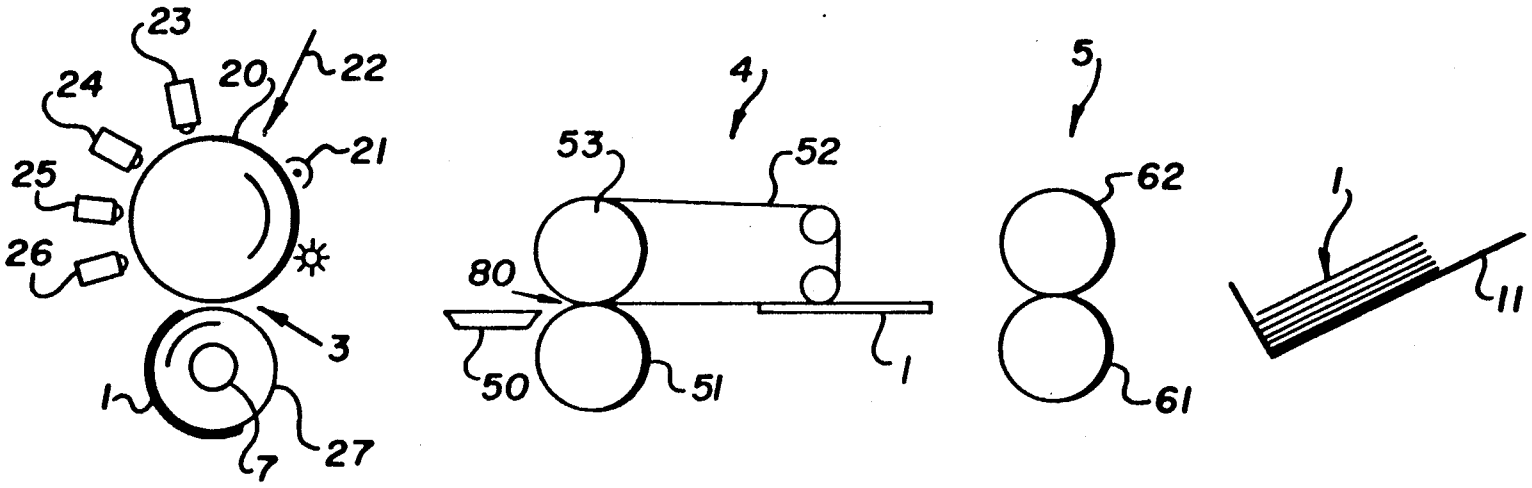
FIG. 1 is a side schematic illustrating a type of image forming apparatus in which the invention is particularly useful.
Figure 2:
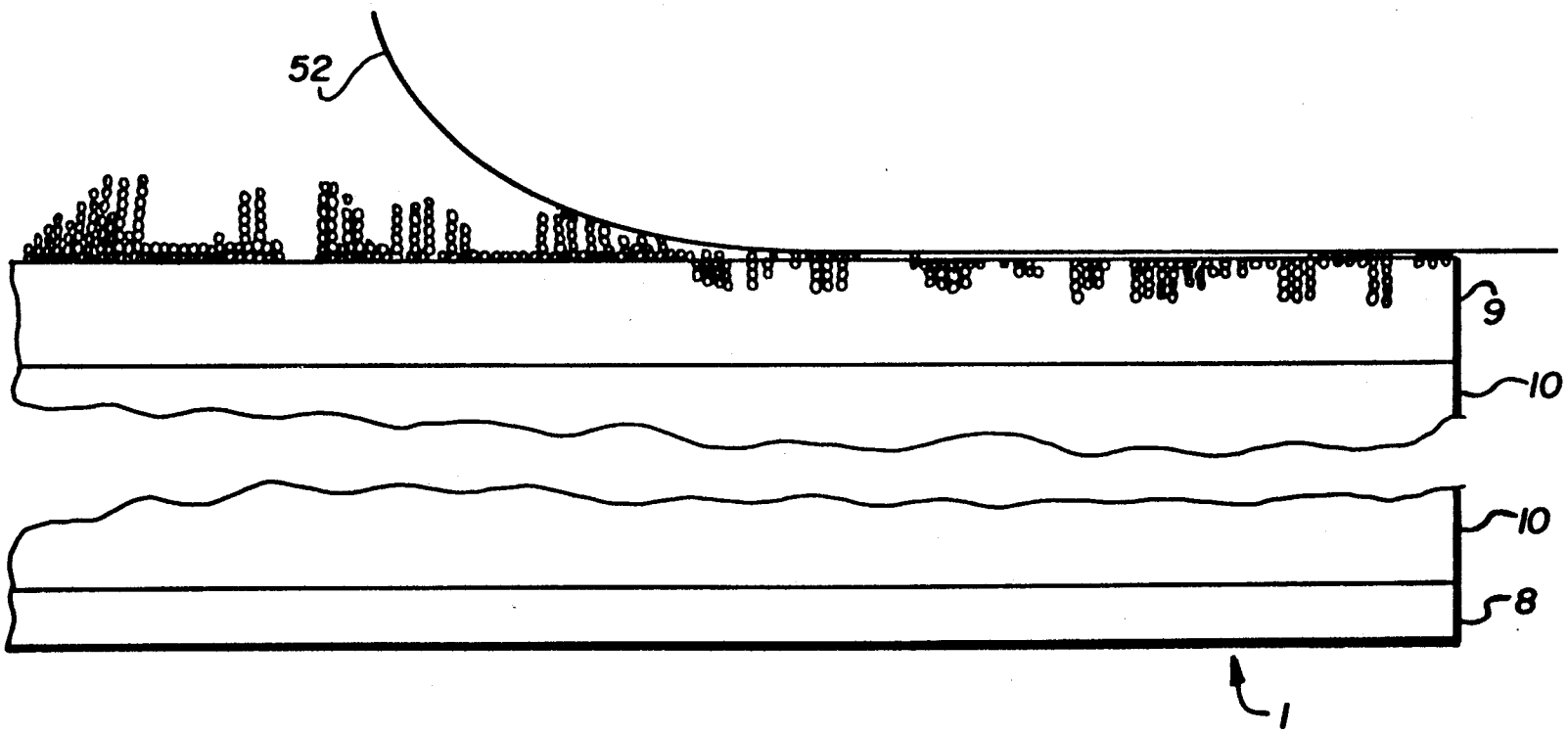
FIG. 2 is a side schematic section, greatly magnified, illustrating the type of receiving sheet and toner image with which the invention is useful.

Referring to FIGS. 1 and 2, a receiving sheet 1 includes a paper support 10, a heat softenable layer 9 and a curl-preventing layer 8. The heat softenable layer 9 is well known in the art and is of a thermoplastic substance which softens generally at a temperature similar to that at which electrophotographic toner softens, for example, about 65° C. The curl-preventing layer is also generally thermoplastic but one that has a melting point substantially above any temperature it would be exposed to in the process.

A series of electrostatic images are formed on an image member 20 using conventional color electrophotography. More specifically, image member 20 is uniformly charged by a charging device 21 and exposed by an exposing device, for example, a laser 22 to create the series of electrostatic images. Each of the images is toned by one of toning stations 23, 24, 25 and 26 to create a series of different color toner images corresponding to the electrostatic images.

The receiving sheet 1 is attached to the periphery of a transfer roller 27 and rotated through a transfer nip 3 to transfer the images to heat softenable layer 9 in registration to form a multicolor image thereon. Transfer is accomplished by heating transfer member 27 internally with a lamp 7 to soften layer 9 and also the toner being transferred. Transfer can also be assisted with an electrostatic field.

The receiving sheet 1 is separated from member 27 and is fed to further apparatus to be finished. For example, as shown in FIG. 1, the image is fixed at a fixing station 4 and texturized at a texturizing station 5 and finally deposited in an output tray 11. Conventionally, fixing device 4 includes a preheating device 50 which raises or maintains the heat softenable layer to or approaching its glass transition temperature, a pair of pressure rollers 51 and 53 and a ferrotyping belt 52 trained about a series of rollers which includes roller 53. Rollers 51 and 53 are urged together with sufficient force to create substantial pressure in a fusing or fixing nip 80 between ferrotyping belt 52 and pressure roller 51. One of the rollers is heated to maintain or raise heat softenable layer 9 above its glass transition temperature and, preferably, to raise or maintain the temperature of the toner also above its glass transition temperature. The heat and pressure combination in the fixing nip causes some of the toner to at least partially embed in heat softenable layer 9, as shown in FIG. 2. Toner that does not become embedded in heat softenable layer 9 is softened and flattened on the surface. If belt 52 has a hard, smooth surface, the image can be smoothed to a high gloss with very little undesirable contour. The image and layer 9 continue out of the nip while maintaining contact with belt 52 until both the image and layer 9 have cooled below their glass transition temperatures. At this point, the receiving sheet 1 is separated from belt 52 and sent on to station 5 for texturizing. Cooling of the image before separation allows separation without the use of offset-preventing liquids which degrade the image.

Texturizing station 5 can also be a belt and a pressure roller. However, it is shown in FIG. 1 as a pair of rollers, at least one of which has a texturizing surface. Again, a combination of heat and pressure is used to apply a texture, for example, a silk or satin finish to the image as desired. Alternatively, station 5 can be used with smooth rollers or another ferrotyping belt to further increase the gloss of the image.

Both stations 4 and 5 have a problem that, if a portion of thermoplastic layer 9 is overheated, that portion can "hot offset" onto the belt or roller touching it. Hot offset has been experienced with the leading edge of receiving sheets fed into a fixing or texturizing nip. This hot offset is caused by a momentary slowing of the pressure members forming the nip as the leading edge of this receiver enters the nip. This momentary slowing can be overcome by a higher powered drive than would ordinarily be used for such a structure. However, that is not an optimum solution.

Figure 3:
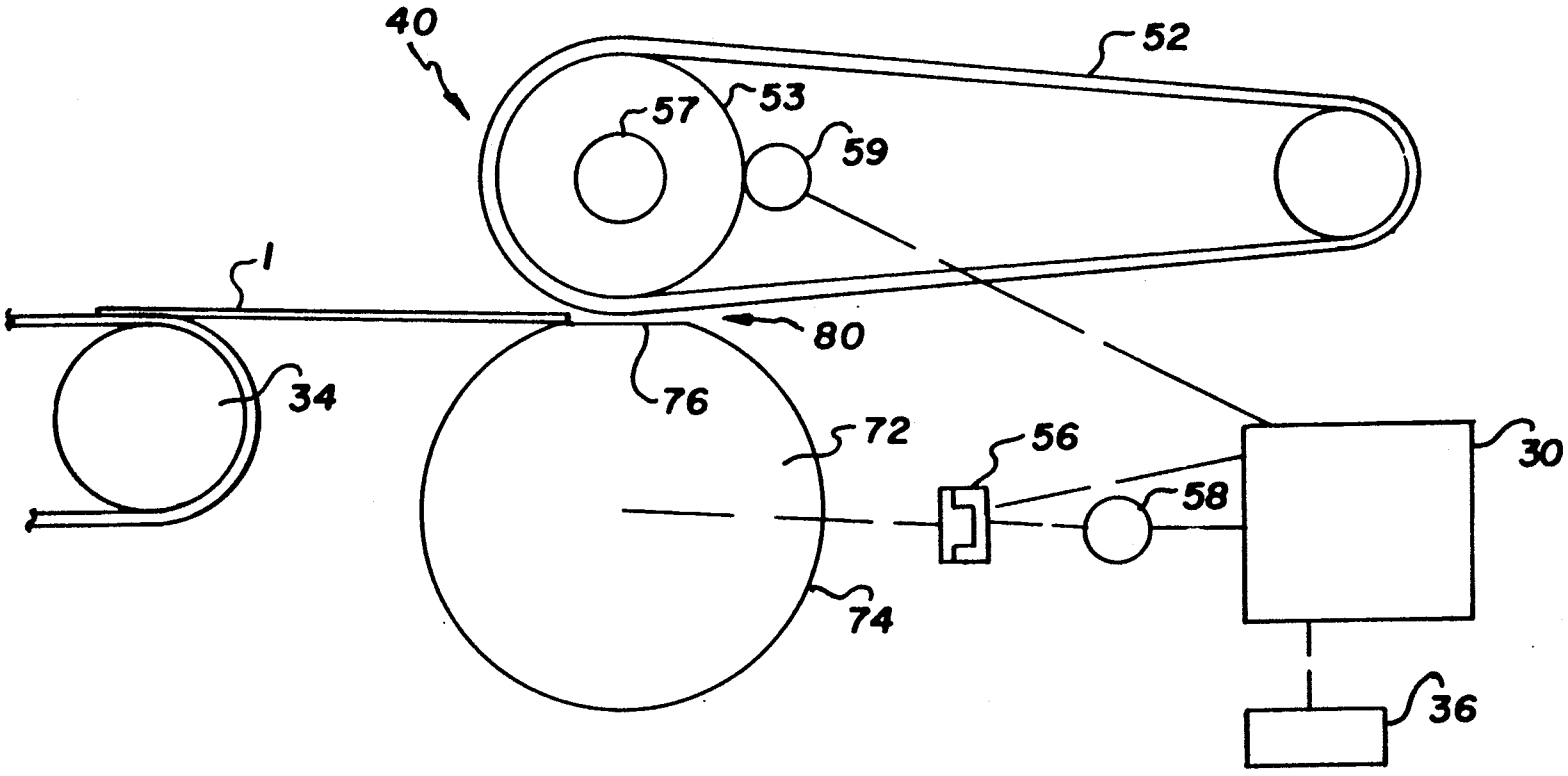
FIGS. 3, 4, 6 and 7 are side schematics of alternative finishing apparatus.
Figure 4:
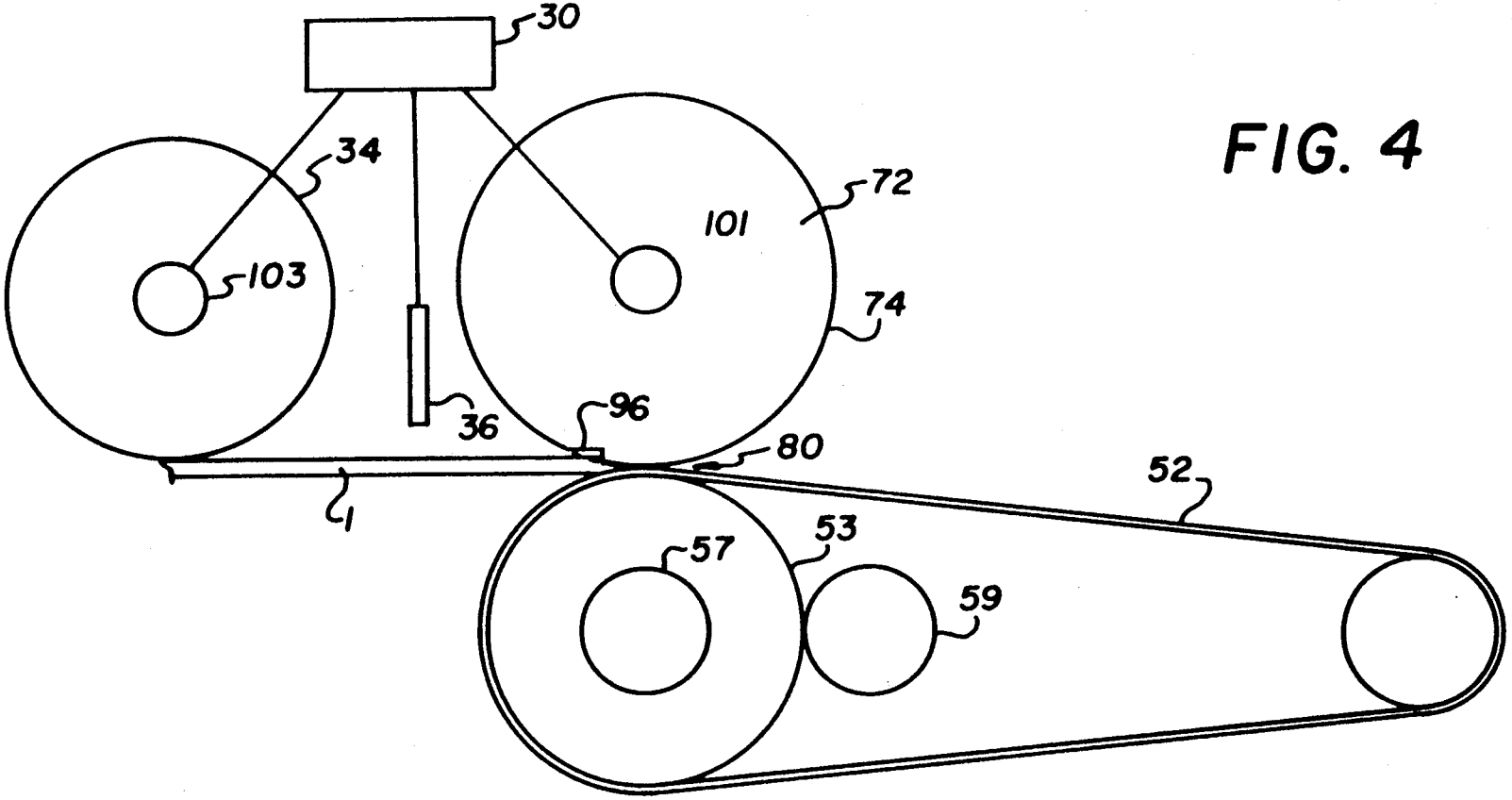
Figure 5:
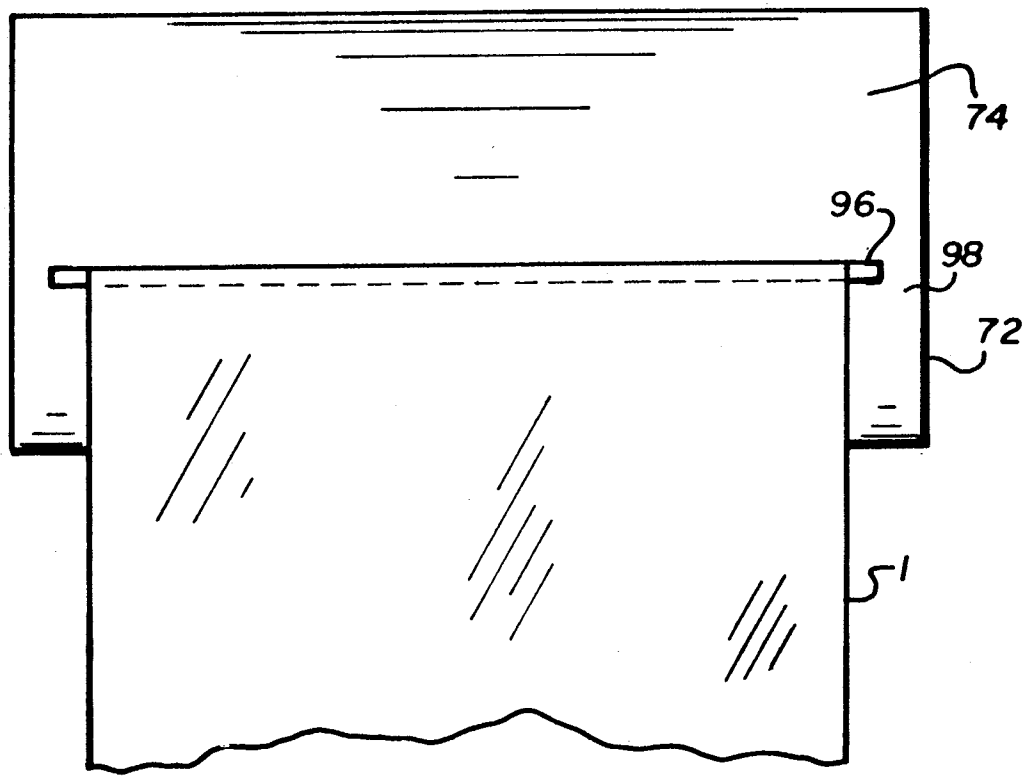
FIG. 5 is a bottom view of a pressure roller shown in FIG. 4.

FIGS. 3-5 show an adjustment in the shape of the pressure roller to automatically relieve the pressure on the leading edge of a receiving sheet, thereby either reducing the tendency of the pressure members to slow or reducing the effect of the slowing by offsetting it by the reduction in pressure. More specifically, referring to FIG. 3, finishing apparatus 40 includes a pair of pressure members, including a fusing member made up of a belt 52 and a backing roller 53 heated by an internal lamp 57, as known in the prior art. Backing roller 53 is driven by a motor 59 which is controlled by a logic and control 30. Receiving sheet 1 is delivered to finishing apparatus 40 by a paper transport 34. The leading edge of receiving sheet 1 is sensed by a suitable sheet sensor 36 which creates a signal conveyed back to logic and control 30.

A pressure roller 72 has a generally cylindrical surface 74 for creating the fixing nip 80 with belt 52. The cylindrical surface 74 has a recess from its cylindrical shape. For example, as shown in FIG. 3, surface 74 has a flat portion 76. The flat portion is positioned facing belt 52 and backing roller 53 as receiving sheet 1 enters nip 80. The first one-eighth to one-quarter inch of receiving sheet 1 is allowed fit against the flat portion 76. At this point, a motor 58 drives pressure roller 72 through a clutch 56 to rotate pressure roller 72 until the cylindrical surface 74 has entered the nip 80. At this point, the rest of the receiving sheet 1 is under full pressure between belt 52 and pressure roller 72 and the entire image and receiving sheet is fixed. The initial one-eighth to one-quarter inch of the receiving sheet has had somewhat less and gradually increasing pressure applied to it because of the flat portion 76. Although there may be some slowing to the movement of web 52 by motor 59 as the receiving sheet 1 enters the nip 80, the effect on the heat softenable layer 9 is counterbalanced by a reduction in pressure from the flat surface 76, and that portion does not hot offset.

Clutch 56 can be disengaged once the cylindrical portion 74 is in nip 80 and the pressure member driven through sheet 1 by belt 52 and motor 59. If the sheet 1 exits the nip 80 before pressure roller 72 has reached the position shown in FIG. 3, roller 72 will stop. This stopping is sensed off the shaft or periphery of roller 72 and clutch 56 re-engated to return roller 72 to its FIG. 3 position. Motor 59 continuously drives roller 53 and belt 52. Timing in control of clutch 56 is handled by logic and control 30 in response to the signal from sensor 36 and a suitable delay.

FIGS. 4 and 5 show an alternative structure for pressure roller 72. The recess in the cylindrical surface 74 contains two surfaces and is somewhat V-shaped in section. Further, as shown best in FIG. 5, the recess 96 does not extend entirely across the cylindrical surface 74 but only far enough to receive the entire crosstrack dimension of receiving sheet 1. This allows edge portions 98 of cylindrical surface 74 to maintain contact with belt 52 and be driven by belt 52 and motor 59 throughout the time that receiving sheet 1 is in nip 80. This eliminates the need for clutch 56 and motor 58. However, it requires timing between sheet movement and pressure roller movement. Preferably, the finishing apparatus 40 is continuously running and sheet 1 movement is varied by varying a drive 103 for vacuum transport 34 in response to an encoder 101 or flag associated with pressure roller 72 and sensor 36. This feature can also be incorporated with the flat surface, or D-shaped, roller shown in FIG. 3. Again, the reduction in hot offset from the recess can be due to either a lessening of the speed reduction effect, from a compensation of that lessening by reduced pressure, or both.

Figure 6:
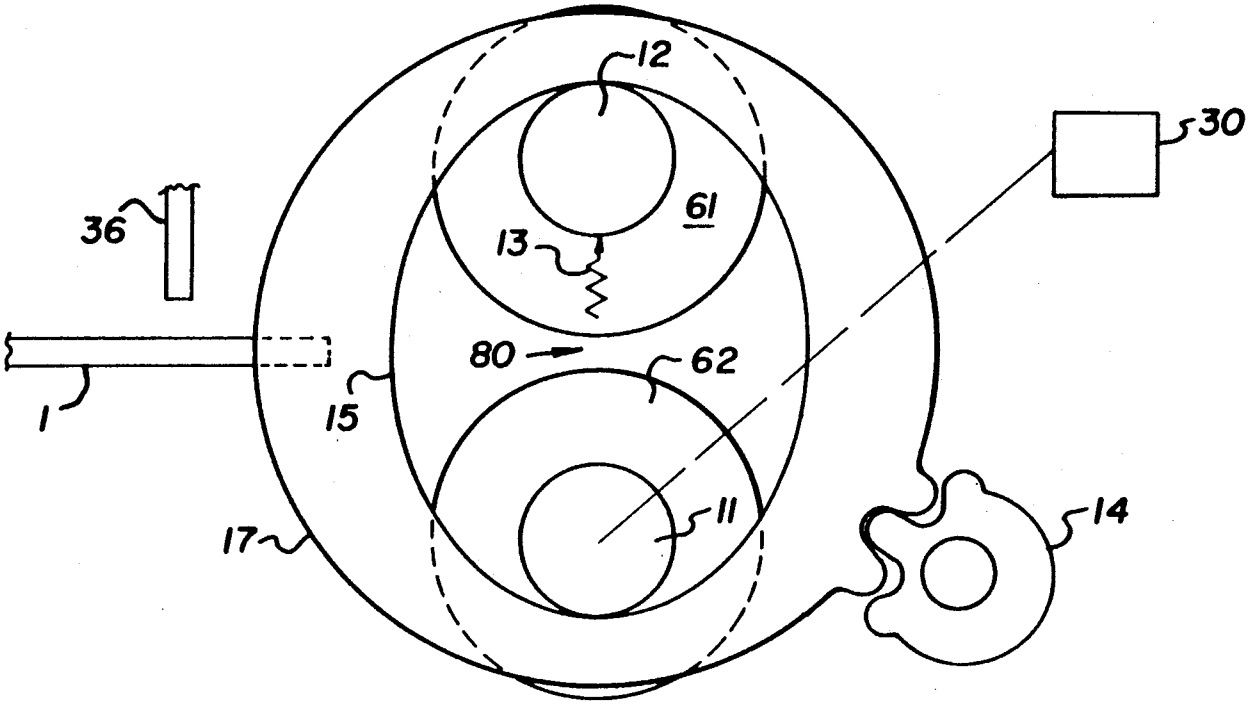
Figure 7:
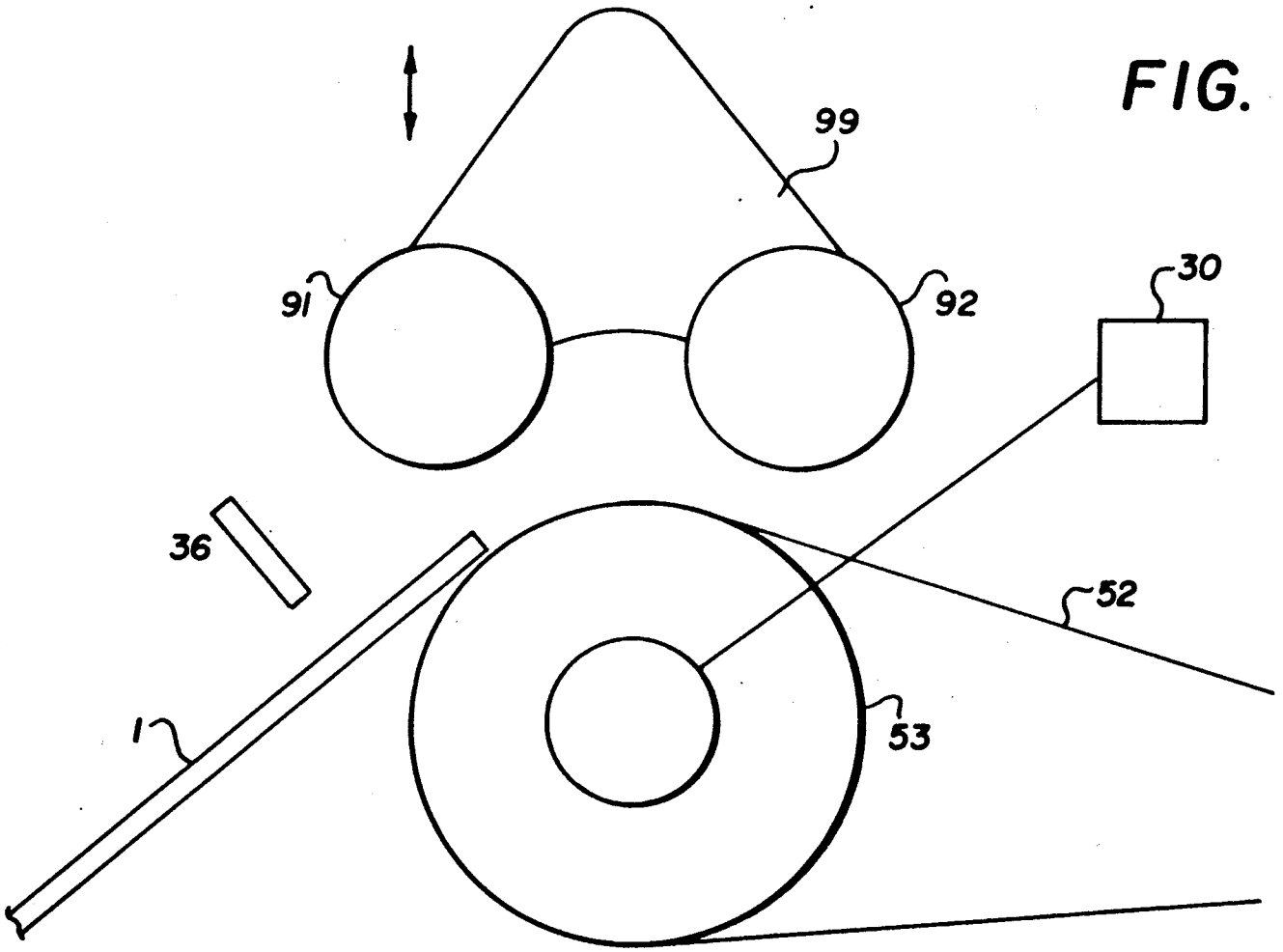

FIGS. 6 and 7 show other mechanisms which are designed to reduce the leading edge hot offset problem discussed herein. Referring to FIG. 6, pressure members 61 and 62 can include a pressure roller and a fusing roller for either fixing or texturizing. They are separated by the urging of a spring 13 acting on a shaft 12 for pressure member 61. The position of shaft 12 with respect to a shaft 11 for pressure member 62 is controlled by an elliptical cam surface 15 in a cam 17.

In operation, receiving sheet 1 reaches the center of nip 80. Logic and control 30 triggers rotation of pinion 14 which, in turn, rotates cam 17. Elliptical surface 15 moves shaft 12 toward shaft 11 to apply pressure in nip 80 for finishing the image on receiving sheet 1. Timing is controlled so that the leading edge of the nip is well into the nip before the pressure is fully applied, thereby making the application of pressure more gradual and reducing the tendency to hot offset.

Referring to FIG. 7, the pressure roller of the preceding embodiments has been replaced by a pair of rollers 91 and 92 held by a yoke 99, which yoke is movable from a position removed from fusing belt 52 to a position in which rollers 91 and 92 both contact belt 52, where it is backed by heated roller 53. In response to a signal from sensor 36, logic and control 30 triggers movement of yoke 99 into its pressure applying position as the leading edge of receiving sheet 1 becomes centered with respect to a nip between roller 91 and belt 52. The toned image facing belt 52 is fixed, to some degree, in the first nip. Thermoplastic and toner flow continues as the heat is being supplied by roller 53 until it reaches a second nip formed by roller 92 and belt 52 where the image gets another pressure pulse to fix the image permanently. The pressure applying yoke 99 is retracted after the trailing edge of receiving sheet 1 has passed both nips.

In all of the embodiments, highest pressure is obtained if both pressure members have hard metallic surfaces. However, even though high pressure is desired in such systems, it is desirable to have some compliance in one of the pressure members. In systems in which high gloss is desired, it is preferred that the pressure member touching the back of the receiving sheet 1 have a compliant surface. This allows the member touching the image and the heat softenable layer to be a hard, smooth metallic surface. The compliance provides some width of nip, improving the heat contact with the fusing member, whether the fusing member be a belt, web or roller.

The invention has been described in detail with particular reference to a preferred embodiment thereof, but it will be understood that variations and modifications can be effected within the spirit and scope of the invention as described hereinabove and as defined in the appended claims.

We claim:

1. Apparatus for finishing a toner image carried on a heat softenable layer on a receiving sheet, said apparatus comprising:

a pair of pressure members forming a pressure nip and including a fusing member and a pressure roller, means for heating at least one of the pressure members, means for driving at least one of the pressure members to move the receiving sheet through the pressure nip, means for feeding the receiving sheet into the pressure nip with the heat softenable layer facing the fusing member, wherein the pressure roller has a cylindrical outer surface with a recess for receiving a leading edge of the receiving sheet as it is fed into the nip to reduce the pressure on a leading portion of the receiving sheet compared to the pressure on the rest of the sheet as the sheet moves through the nip.

2. Apparatus according to claim 1 wherein the fusing member is a belt having a hard, smooth surface for contacting the image and heat softenable layer of the receiving sheet.

3. Apparatus according to claim 2 wherein the belt is backed by a heated roller.

4. Apparatus according to claim 1 wherein the recess is a flat area on the roller.

5. Apparatus according to claim 4 wherein said drive means includes means for continuously driving the fusing member and auxiliary drive means for driving the pressure roller after the receiving sheet has reached the nip until the flat area of the pressure roller is through the pressure nip.

6. Apparatus according to claim 1 wherein said recess does not extend entirely across the pressure roller leaving edges of the pressure roller which are continuous with the cylindrical surface of the pressure roller and which maintain contact with the fusing member to continuously drive the pressure roller in response to movement of the fusing member.

7. Apparatus according to claim 6 wherein said recess has two surfaces forming a generally V-shaped recess into the pressure roller from the cylindrical surface.

* * * * *